US011533979B1

(12) United States Patent
Rehan

(10) Patent No.: US 11,533,979 B1
(45) Date of Patent: Dec. 27, 2022

(54) ROTATING LOTION-DISPENSING BODY BRUSH

(71) Applicant: Samira Rehan, Mississauga (CA)

(72) Inventor: Samira Rehan, Mississauga (CA)

( * ) Notice: Subject to any disclaimer, the term of this patent is extended or adjusted under 35 U.S.C. 154(b) by 0 days.

(21) Appl. No.: 17/504,661

(22) Filed: Oct. 19, 2021

(51) Int. Cl.

| | |
|---|---|
| ***A45D 34/04*** | (2006.01) |
| ***A45D 40/26*** | (2006.01) |
| ***A46B 11/00*** | (2006.01) |
| ***A46B 13/00*** | (2006.01) |
| ***A46B 13/02*** | (2006.01) |

(52) U.S. Cl.
CPC ..... *A45D 34/042* (2013.01); *A46B 11/0006* (2013.01); *A46B 11/0072* (2013.01); *A46B 13/008* (2013.01); *A45D 40/262* (2013.01); *A45D 2200/054* (2013.01); *A45D 2200/1054* (2013.01); *A45D 2200/1081* (2013.01); *A46B 11/001* (2013.01); *A46B 11/002* (2013.01); *A46B 13/02* (2013.01); *A46B 2200/1046* (2013.01)

(58) Field of Classification Search
CPC ... A46B 11/0006; A46B 11/00; A46B 11/001; A46B 11/002; A46B 11/0072; A46B 13/00; A46B 13/008; A46B 13/02; A46B 2200/1046; A45D 34/042; A45D 40/262; A45D 2200/054; A45D 2200/1054; A45D 2200/10; A45D 2200/1081
USPC ..... 401/268, 270, 188 R, 6
See application file for complete search history.

(56) References Cited

U.S. PATENT DOCUMENTS

| | | | | |
|---|---|---|---|---|
| 5,500,972 | A | 3/1996 | Foster | |
| 5,647,841 | A | 7/1997 | Groenewold | |
| 6,170,108 | B1 | 1/2001 | Knight | |
| 6,957,925 | B1 * | 10/2005 | Jacobs | A46B 11/001 401/175 |
| 7,503,715 | B2 * | 3/2009 | Khubani | A61H 7/005 401/6 |
| 8,167,510 | B2 * | 5/2012 | LaFlamme | A47L 13/26 401/206 |
| 9,339,104 | B2 | 5/2016 | O'Neill | |
| 9,603,432 | B2 * | 3/2017 | Shahrur | A46B 13/04 |
| 9,681,782 | B2 | 6/2017 | McCauley | |
| D850,726 | S | 6/2019 | Lopez | |
| 2007/0243005 | A1 | 10/2007 | Sviesa | |

* cited by examiner

*Primary Examiner* — David J Walczak
(74) *Attorney, Agent, or Firm* — Kyle A. Fletcher, Esq.

(57) ABSTRACT

The rotating lotion dispensing body brush is a brush. The rotating lotion dispensing body brush is adapted for use with a patient. The rotating lotion dispensing body brush is configured for use with a lotion. The rotating lotion dispensing body brush applies the lotion to the patient. The rotating lotion dispensing body brush comprises a brush structure, a control circuit, and a fluidic network. The brush structure contains the lotion, the control circuit, and the fluidic network. The control circuit pumps the lotion through the fluidic network. The control circuit rotates the brush structure. The fluidic network transports the lotion from the brush head to the patient.

10 Claims, 6 Drawing Sheets

ROTATING LOTION-DISPENSING BODY BRUSH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of brushes including brushes with driven brush bodies and a reservoir for supplying substances. (A46B13/04)

SUMMARY OF INVENTION

The rotating lotion dispensing body brush is a brush. The rotating lotion dispensing body brush is adapted for use with a patient. The rotating lotion dispensing body brush is configured for use with a sunblock, pain-relieving medicine, or a lotion. The rotating lotion dispensing body brush applies the lotion to the patient. The rotating lotion dispensing body brush comprises a brush structure, a control circuit, and a fluidic network. The brush structure contains the lotion, the control circuit, and the fluidic network. The control circuit pumps the lotion through the fluidic network. The control circuit rotates the brush structure. The fluidic network transports the lotion from the brush head to the patient.

These together with additional objects, features and advantages of the rotating lotion dispensing body brush will be readily apparent to those of ordinary skill in the art upon reading the following detailed description of the presently preferred, but nonetheless illustrative, embodiments when taken in conjunction with the accompanying drawings.

In this respect, before explaining the current embodiments of the rotating lotion dispensing body brush in detail, it is to be understood that the rotating lotion dispensing body brush is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotating lotion dispensing body brush.

It is therefore important that the claims be regarded as including such equivalent construction insofar as they do not depart from the spirit and scope of the rotating lotion dispensing body brush. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figures 1, 5:
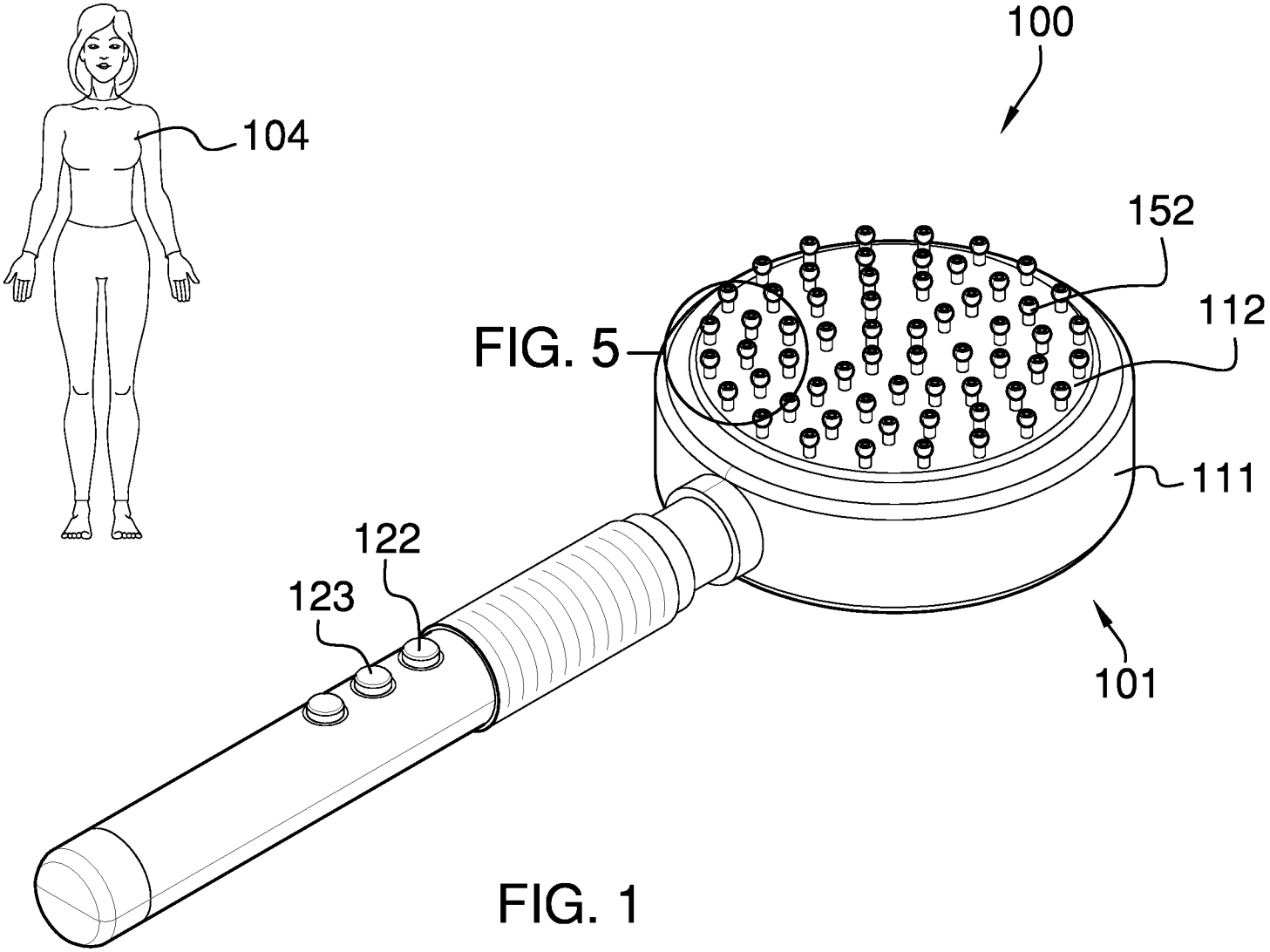
FIG. 1 is a perspective view of an embodiment of the disclosure.
FIG. 5 is a detail view of an embodiment of the disclosure.
Figure 2:
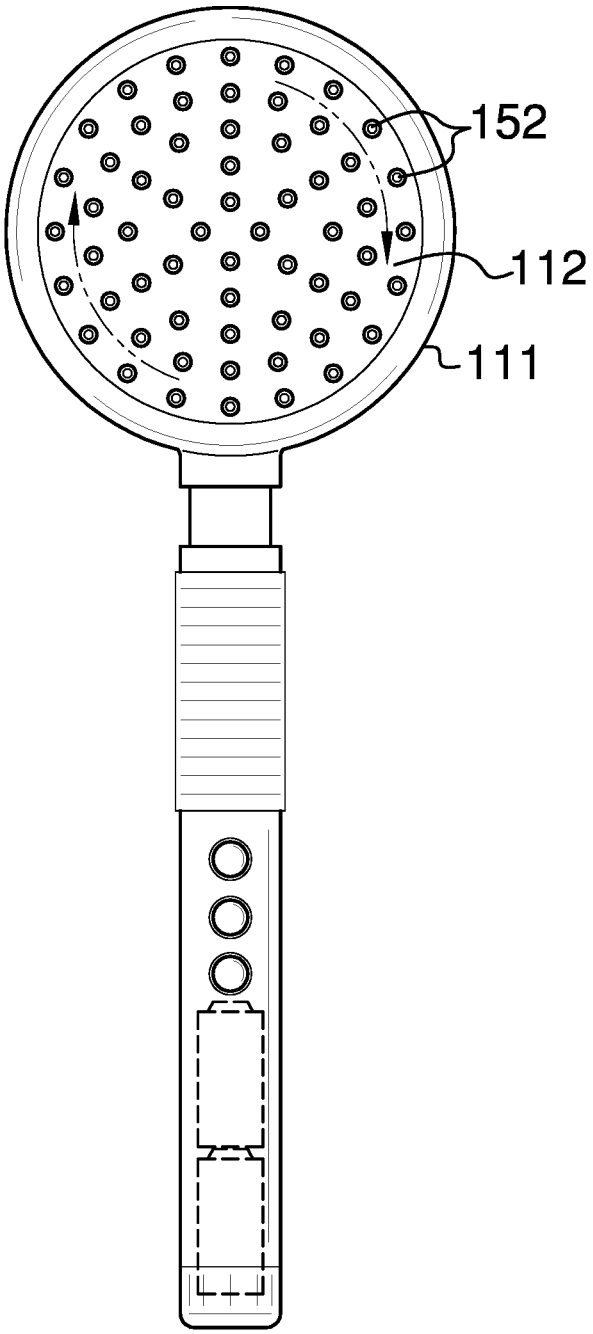
FIG. 2 is a front view of an embodiment of the disclosure.
Figure 3:
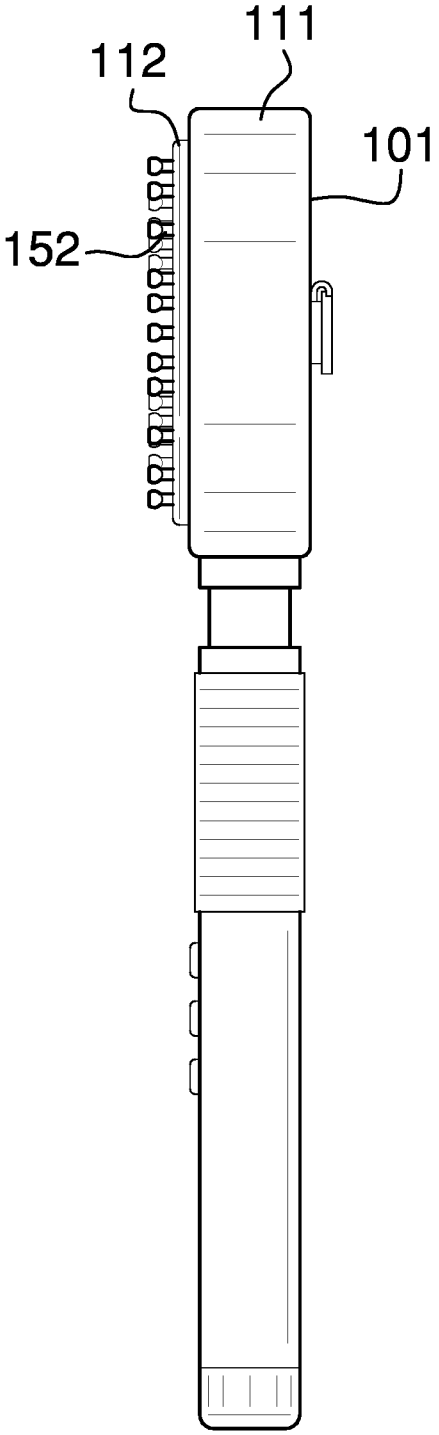
FIG. 3 is a side view of an embodiment of the disclosure.
Figure 4:
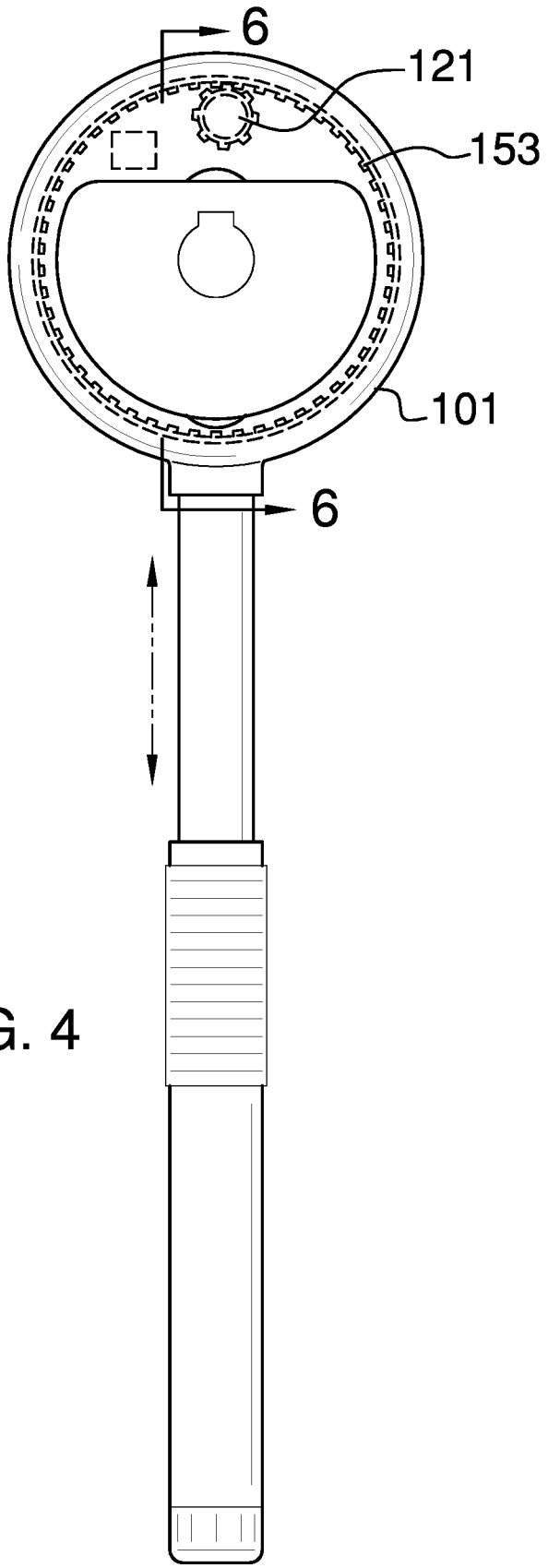
FIG. 4 is a rear view of an embodiment of the disclosure.
Figure 5:
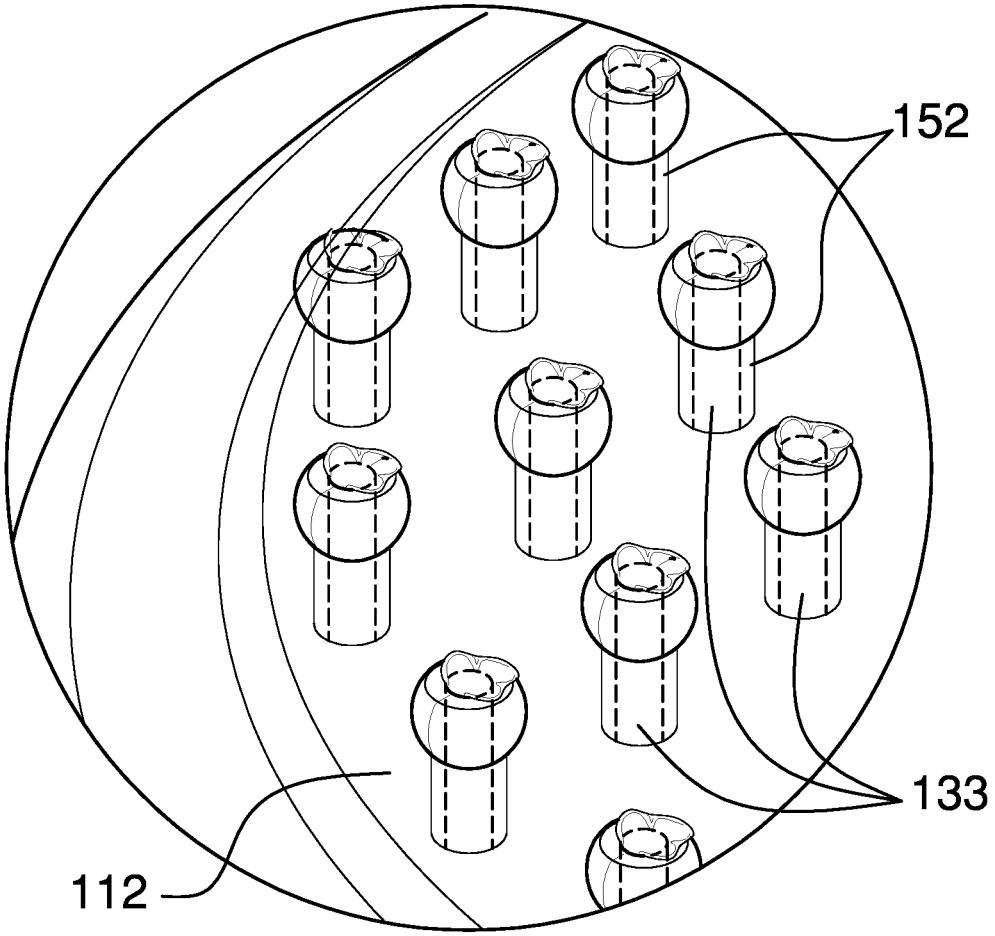
Figure 6:
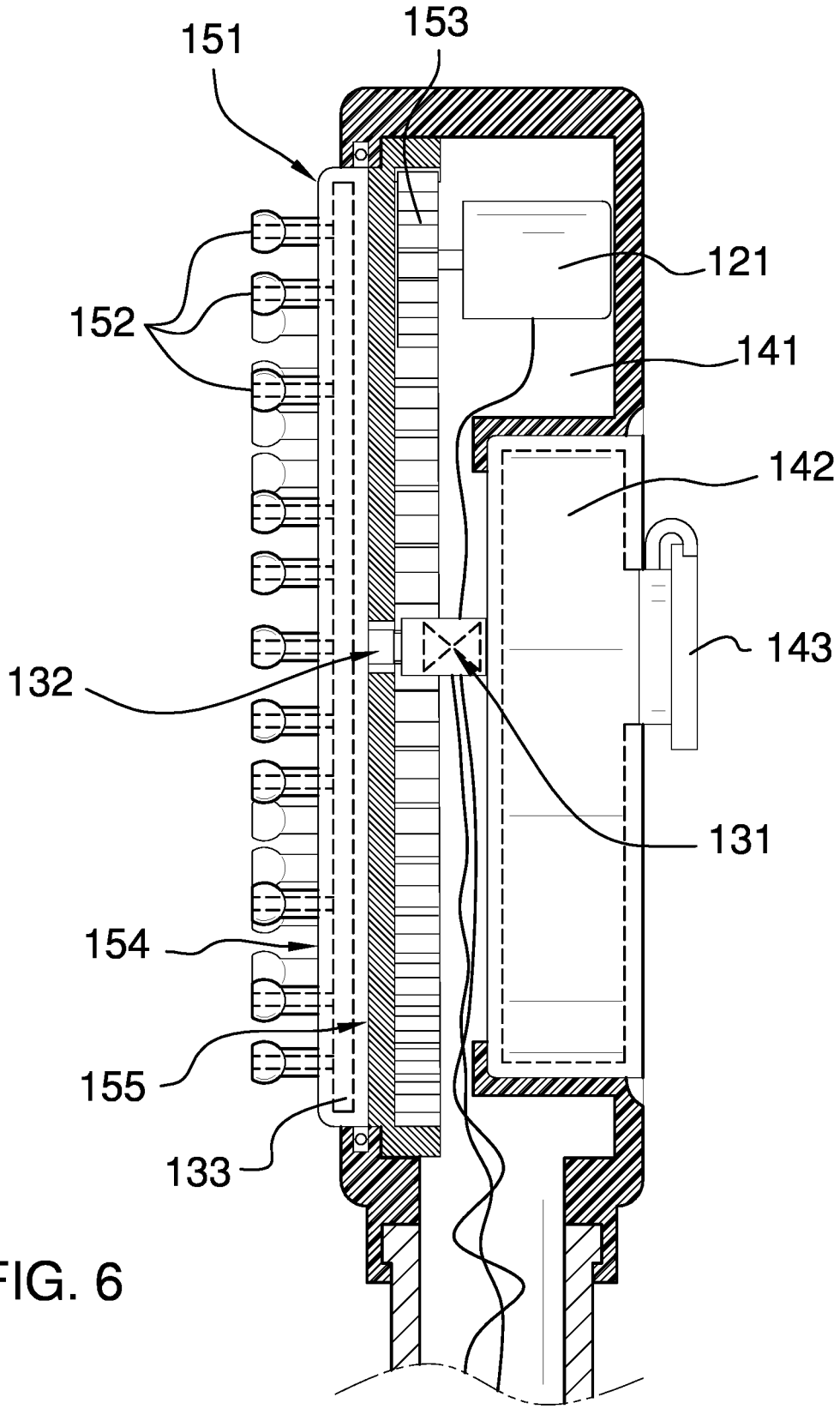
FIG. 6 is a detail view of an embodiment of the disclosure.
Figure 7:
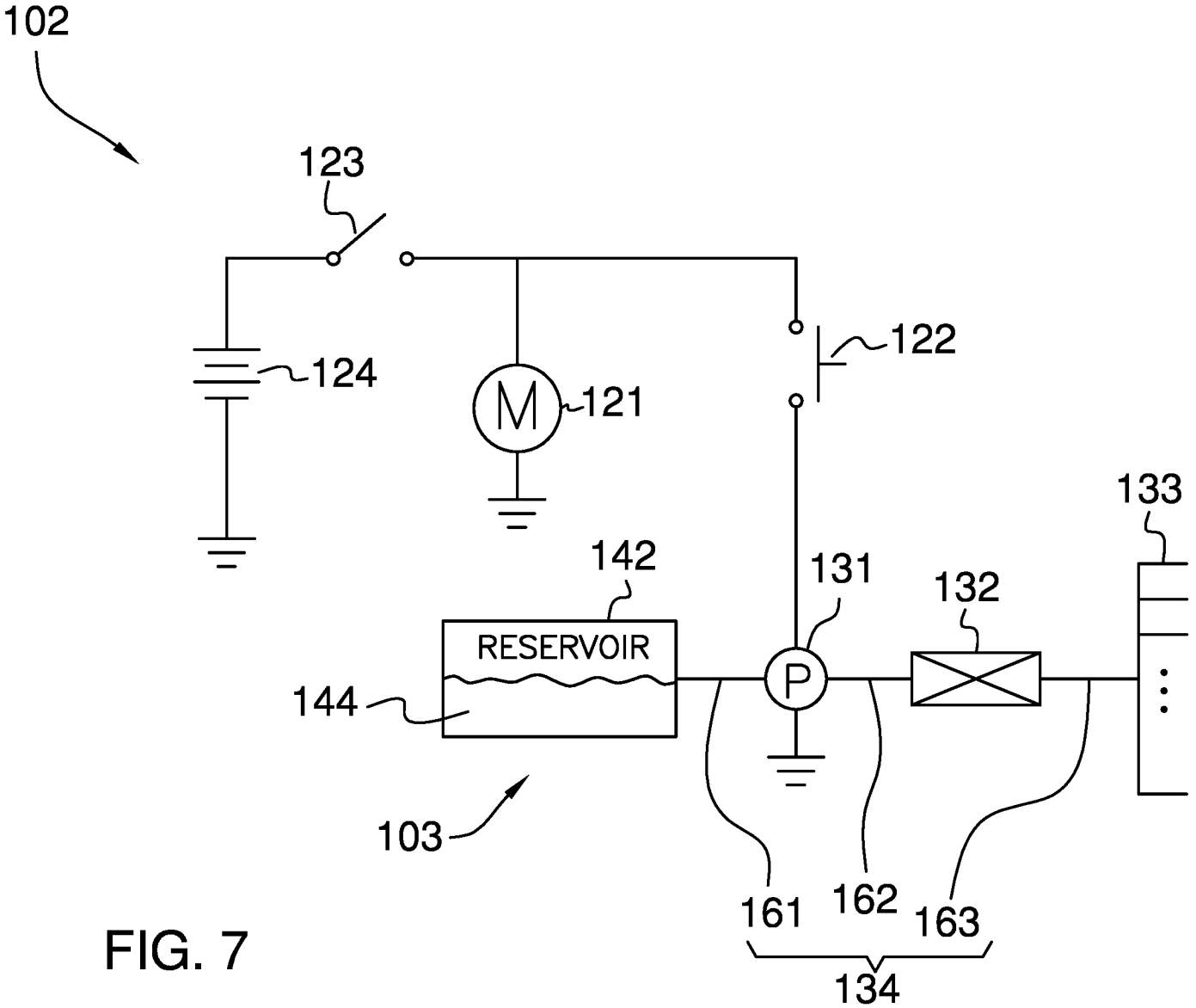
FIG. 7 is a schematic view of an embodiment of the disclosure.

Detailed reference will now be made to one or more potential embodiments of the disclosure, which are illustrated in FIGS. 1 through 7.

The rotating lotion dispensing body brush 100 (hereinafter invention) is a brush. The invention 100 is adapted for use with a patient 104. The invention 100 is configured for use with a lotion 144. The invention 100 applies the lotion 144 to the patient 104. The invention 100 comprises a brush structure 101, a control circuit 102, and a fluidic network 103. The brush structure 101 contains the lotion 144, the control circuit 102, and the fluidic network 103. The control circuit 102 pumps the lotion 144 through the fluidic network 103. The control circuit 102 rotates the brush structure 101. The fluidic network 103 transports the lotion 144 from the brush head 112 to the patient 104. The patient 104 is defined elsewhere in this disclosure. The lotion 144 is a cosmetic media. The lotion 144 has a liquid phase. The lotion 144 is defined elsewhere in this disclosure.

The brush structure 101 is a mechanical structure. The brush structure 101 is a rotating structure. The brush structure 101 is a tool. The brush structure 101 is a brush. The control circuit 102 controls the operation of the brush structure 101. The fluidic network 103 forms a fluidic connection with the brush structure 101. The fluidic network 103 dispenses the lotion 144 from the brush structure 101. The brush structure 101 cleans the patient 104. The brush structure 101 generates a friction against the patient 104 that removes detritus from the patient 104. The brush structure 101 applies the lotion 144 to the skin of the patient 104. The brush structure 101 comprises a base pan 111 and a brush head 112.

The base pan 111 is a prism-shaped structure. The base pan 111 is a hollow structure. The base pan 111 has a pan shape. The base pan 111 forms a shell that contains the control circuit 102 and the fluidic network 103. The base pan 111 is formed with all the apertures and form factors necessary to accommodate the operation of the brush head 112, the control circuit 102, and the fluidic network 103. The base pan 111 comprises a drive chamber 141 and a reservoir 142. The reservoir 142 further comprises a reservoir 142 cap 143.

The drive chamber 141 is the hollow interior of the pan structure of the base pan 111. The drive chamber 141 contains the reservoir 142, the pump 131, and the battery 124. The reservoir 142 is a storage structure. The reservoir 142 stores the lotion 144 in anticipation of use. The reservoir 142 receives the lotion 144 through the reservoir 142 cap 143. The reservoir 142 discharges the lotion 144 into the pump 131 of the fluidic network 103. The reservoir 142 cap 143 is a mechanical structure. The reservoir 142 cap 143 forms a port that allows the reservoir 142 to receive the lotion 144 for storage. The reservoir 142 cap 143 is an enclosable structure such that the lotion 144 stored in the reservoir 142 will not leak out of the reservoir 142.

The brush head 112 is a mechanical structure. The brush head 112 is formed with a bristle structure 152 used to generate the friction used to clean the patient 104. The brush head 112 mounts in the open face of the pan structure of the base pan 111 such that the bristle structure 152 projects away from the center of the base pan 111. The brush head 112 mounts in the base pan 111 such that the brush head 112 rotates relative to the base pan 111. The brush head 112 comprises a brush disk 151, a bristle structure 152, and a perimeter gear 153.

The brush disk 151 is a disk-shaped structure. The brush disk 151 is geometrically similar to the open face of the pan structure of the base pan 111. The brush disk 151 mounts in the open face of the base pan 111 such that the brush disk 151 rotates within the base pan 111. The brush disk 151 further comprises an exterior face 154 and an interior face 155. The exterior face 154 is the congruent end of the disk structure of the brush disk 151 that is distal from the center of the base pan 111. The interior face 155 is the congruent end of the disk structure of the brush disk 151 that is proximal to the center of the base pan 111.

The bristle structure 152 is a mechanical structure. The bristle structure 152 mounts on the exterior face 154 of the disk structure of the brush disk 151. The bristle structure 152 is placed against the skin of the patient 104. The rotation of the brush disk 151 causes the bristle structure 152 to generate a friction against the skin of the patient 104. The bristle structure 152 further contains the brush manifold 133. The lotion 144 is applied to the patient 104 through the bristle structure 152 as the bristle structure 152 is generating a friction against the patient 104.

The perimeter gear 153 is a gear. The perimeter gear 153 mounts on the interior face 155 of the disk structure of the brush disk 151. The perimeter gear 153 meshes with the electric motor 121 of the control circuit 102 such that the rotation of the electric motor 121 rotates the brush head 112 within the base pan 111 of the brush structure 101.

The control circuit 102 is an electric circuit. The control circuit 102 provides the motive forces necessary to rotate the brush structure 101. The control circuit 102 provides the electric energy necessary to pump the lotion 144 from the brush structure 101 onto the patient 104. The control circuit 102 comprises an electric motor 121, a pump 131 switch 122, a master switch 123, and a battery 124.

The electric motor 121 is an electric device that converts electric energy into rotational energy. The electric motor 121 is defined elsewhere in this disclosure. The electric motor 121 is formed with a gear that meshes with the perimeter gear 153 of the brush head 112 such that the rotation of the electric motor 121 rotates the brush head 112.

The pump 131 switch 122 is an electric switch. The pump 131 switch 122 is a momentary switch. The pump 131 switch 122 forms a series electric connection between the master switch 123 and the pump 131 of the fluidic network 103. The pump 131 switch 122 controls the flow of electric energy between the pump 131 and the master switch 123. The pump 131 switch 122 controls the operation of the pump 131 by controlling the flow of electric energy into the pump 131.

The master switch 123 is an electric switch. The master switch 123 is a momentary switch. The master switch 123 forms an electric connection between the battery 124 and the electric motor 121. The master switch 123 forms an electric connection between the battery 124 and the pump 131 switch 122. The master switch 123 controls the flow of electric energy between the battery 124 and the electric motor 121. The master switch 123 controls the operation of the electric motor 121 by controlling the flow of electric energy into the electric motor 121. The master switch 123 further disables the operation of the pump 131 when the master switch 123 is actuated to an open position.

The battery 124 is an electrochemical device. The battery 124 converts chemical potential energy into electric energy. The battery 124 provides the electric energy necessary to operate the invention 100.

The fluidic network 103 stores the lotion 144 in anticipation of use. The fluidic network 103 pumps the lotion 144 from the brush structure 101. The fluidic network 103 pumps the lotion 144 with adequate force to drive the lotion 144 through the brush structure 101 and onto the patient 104. The fluidic network 103 comprises a pump 131, a rotary union 132, a brush manifold 133, and a plurality of fluidic connections 134.

The pump 131 is a mechanical device. The pump 131 is an electrically powered device. The pump 131 draws electric energy from the control circuit 102. The control circuit 102 controls the operation of the pump 131 by controlling the flow of electric energy into the pump 131. The pump 131 generates the pressure differential that provides the motive forces to transport the lotion 144 from the reservoir 142 into the brush head 112 and onto the patient 104.

The rotary union 132 forms a fluidic connection between the pump 131 and the brush manifold 133. The rotary union 132 is defined elsewhere in this disclosure. The rotary union 132 is a rotating structure that allow the lotion 144 to flow from the pump 131 into the brush manifold 133 as the brush head 112 is rotating relative to the base pan 111.

The brush manifold 133 is a manifold. The manifold is defined elsewhere in this disclosure. The brush manifold 133 forms a fluidic connection between the rotary union 132 and the bristle structure 152 of the brush head 112 such that the lotion 144 flows through the bristle structure 152 onto the patient 104.

The plurality of fluidic connections 134 forms a fluid network that interconnects the fluidic network 103. The plurality of fluidic connections 134 further comprises a first fluidic connection 161, a second fluidic connection 162, and a third fluidic connection 163. The first fluidic connection 161 forms a fluidic connection between the reservoir 142 of the base pan 111 and the pump 131. The second fluidic connection 162 forms a fluidic connection between the pump 131 and the rotary union 132. The third fluidic connection 163 forms a fluidic connection between the rotary union 132 and the bristle structure 152 of the brush head 112.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power. Batteries are commonly defined with a positive terminal and a negative terminal.

Brush: As used in this disclosure, a brush is a device comprising a plurality of bristles set into a handle or a base that is used for grooming, sweeping, smoothing, scrubbing, or painting.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cosmetic Media: As used in this disclosure, a cosmetic media refers to a chemical substance that is topically applied to a biological organism. The purposes for a cosmetic media include, but are not limited to: a) cleaning the skin and the hair of the biological organism; b) changing the visual, olfactory, and tactile stimuli presented by the biological organism to other nearby biological organisms; and, c) the topical application of a pharmacologically active media.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Detritus: As used in this disclosure, detritus refers to an accumulation of unwanted material on a surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Fluid Network: As used in this disclosure, a fluid network refers to a transport structure that: a) receives a fluid into the fluid network; b) transports the fluid through a series of pipes, valves, and manifolds; and, c) discharges the fluid from the fluid network.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Liquid: As used in this disclosure, a liquid refers to a state (phase) of matter that is fluid and that maintains, for a given pressure, a fixed volume that is independent of the volume of the container.

Lotion: As used in this disclosure, a lotion is a smooth viscous liquid that is used for medical, hygienic, or cosmetic purposes. Lotions are commonly used as a delivery device for applying a pharmacologically active media such as an antibiotic ointment, a surfactant such as a soap, a skin moisturizer.

Manifold: As used in this disclosure, a manifold is a pipe or chamber having several ports through which one or more fluids are gathered or distributed.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Patient: As used in this disclosure, a patient is a person who is designated to receive a medical treatment, therapy or service. The term patient may be extended to an animal when used within the context of the animal receiving veterinary treatment or services.

Perimeter: As used in this disclosure, a perimeter is one or more curved or straight lines that bounds an enclosed area on a plane or surface. The perimeter of a circle is commonly referred to as a circumference.

Pharmacologically Active Media: As used in this disclosure, a pharmacologically active media refers to a chemical substance that has a biochemical or physiological effect on a biological organism.

Phase: As used in this disclosure, phase refers to the state of the form of matter. The common states of matter are solid, liquid, gas, and plasma.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Reservoir: As used in this disclosure, a reservoir refers to a container or containment system that is configured to store a liquid.

Rotary Union: As used in this disclosure, a rotary union is a commercially available plumbing fitting that forms fluidic connection between a stationary source and a rotating structure.

Shell: As used in this disclosure, a shell is a structure that forms an outer covering intended to contain an object. Shells are often, but not necessarily, rigid or semi-rigid structures that are intended to protect the object contained within it.

Solid: As used in this disclosure, a solid refers to a state (phase) of matter that: 1) has a fixed volume; and, 2) does not flow.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Tool: As used in this disclosure, a tool is a device, an apparatus, or an instrument that is used to carry out an activity, operation, or procedure.

Topical: As used in this disclosure, topical is an adjective that is associated with a pharmacologically active media. Topical indicates that the pharmacologically active media is applied directly to the skin.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A rotating lotion dispensing body brush comprising
a brush structure, a control circuit, and a fluidic network;
wherein the brush structure contains the control circuit and the fluidic network;
wherein the rotating lotion dispensing body brush is a brush;
wherein the rotating lotion dispensing body brush is adapted for use with a patient;
wherein the rotating lotion dispensing body brush is configured for use with a lotion;
wherein the rotating lotion dispensing body brush is adapted to apply the lotion to the patient;
wherein the brush structure is adapted to contain the lotion;
wherein the fluidic network comprises a pump, a rotary union, a brush manifold, and a plurality of fluidic connections;
wherein the rotary union forms a fluidic connection between the pump and the brush manifold;
wherein the plurality of fluidic connections interconnects the fluidic network;
wherein the control circuit pumps the lotion through the fluidic network;
wherein the control circuit rotates the brush head;
wherein the fluidic network transports the lotion from the brush head to the patient;
wherein the brush structure is a mechanical structure;
wherein the brush structure is a rotating structure;
wherein the brush structure is a tool;
wherein the brush structure is a brush;
wherein the brush structure generates a friction against the patient;
wherein the brush structure applies the lotion to the patient;
wherein the control circuit is an electric circuit;
wherein the control circuit provides motive forces necessary to rotate the brush head;
wherein the control circuit provides electric energy necessary to pump the lotion from the brush structure onto the patient;
wherein the fluidic network pumps the lotion from the brush structure;
wherein the fluidic network pumps the lotion with adequate force to drive the lotion through the brush structure and onto the patient;
wherein the brush structure comprises a base pan and a brush head;
wherein the brush head mounts in the base pan;
wherein the control circuit comprises an electric motor, a pump switch, a master switch, and a battery;
wherein the electric motor is an electric device that converts electric energy into rotational energy;
wherein the pump switch controls the operation of the pump by controlling the flow of electric energy into the pump;
wherein the master switch controls the operation of the electric motor by controlling the flow of electric energy into the electric motor;
wherein the master switch further disables the operation of the pump when the master switch is actuated to an open position;
wherein the base pan is a prism-shaped structure;
wherein the base pan is a hollow structure;
wherein the base pan has a pan shape;
wherein the base pan forms a shell that contains the control circuit and the fluidic network.

2. The rotating lotion dispensing body brush according to claim 1
wherein the base pan comprises a drive chamber and a reservoir;
wherein the reservoir further comprises a reservoir cap;
wherein the drive chamber is a hollow interior of the pan structure of the base pan;
wherein the drive chamber contains the reservoir, the pump, and the battery;
wherein the reservoir is a storage structure;
wherein the reservoir stores the lotion;
wherein the reservoir receives the lotion through the reservoir cap;
wherein the reservoir cap is a mechanical structure;
wherein the reservoir cap forms a port that allows the reservoir to receive the lotion for storage;
wherein the reservoir cap is an enclosable structure.

3. The rotating lotion dispensing body brush according to claim 2
wherein the brush head is a mechanical structure;
wherein the brush head is formed with a bristle structure used to generate the friction used to clean the patient;
wherein the brush head mounts in an open face of the pan structure of the base pan such that the bristle structure projects away from the center of the base pan;
wherein the brush head mounts in the base pan such that the brush head rotates relative to the base pan.

4. The rotating lotion dispensing body brush according to claim 3
wherein the brush head comprises a brush disk, a bristle structure, and a perimeter gear;
wherein the brush disk is a disk-shaped structure;
wherein the brush disk is geometrically similar to the open face of the pan structure of the base pan;
wherein the brush disk mounts in an open face of the base pan such that the brush disk rotates within the base pan;
wherein the brush disk further comprises an exterior face and an interior face;
wherein the exterior face is the congruent end of a disk structure of the brush disk that is distal from the center of the base pan;
wherein the interior face is the congruent end of the disk structure of the brush disk that is proximate to the center of the base pan.

5. The rotating lotion dispensing body brush according to claim 4
wherein the bristle structure is a mechanical structure;
wherein the bristle structure mounts on the exterior face of the disk structure of the brush disk;
wherein the bristle structure is placed against the skin of the patient;

wherein the rotation of the brush disk causes the bristle structure to generate a friction against the skin of the patient;

wherein the bristle structure further contains the brush manifold;

wherein the lotion is applied to the patient through the bristle structure as the bristle structure is generating a friction against the patient.

6. The rotating lotion dispensing body brush according to claim 5 wherein the perimeter gear is a gear;

wherein the perimeter gear mounts on the interior face of the disk structure of the brush disk;

wherein the perimeter gear meshes with the electric motor of the control circuit such that the rotation of the electric motor rotates the brush head within the base pan of the brush structure.

7. The rotating lotion dispensing body brush according to claim 6 wherein the electric motor is formed with a gear that meshes with the perimeter gear of the brush head such that the rotation of the electric motor rotates the brush head.

8. The rotating lotion dispensing body brush according to claim 7 wherein the pump switch is an electric switch;

wherein the pump switch is a momentary switch;

wherein the pump switch forms a series electric connection between the master switch and the pump of the fluidic network;

wherein the pump switch controls the flow of electric energy between the pump and the master switch.

9. The rotating lotion dispensing body brush according to claim 8 wherein the master switch is an electric switch;

wherein the master switch is a momentary switch;

wherein the master switch forms an electric connection between the battery and the electric motor;

wherein the master switch forms an electric connection between the battery and the pump switch;

wherein the master switch controls the flow of electric energy between the battery and the electric motor;

wherein the battery is an electrochemical device;

wherein the battery converts chemical potential energy into electric energy;

wherein the battery provides the electric energy necessary to operate the rotating lotion dispensing body brush.

10. The rotating lotion dispensing body brush according to claim 9 wherein the pump is a mechanical device;

wherein the pump is an electrically powered device;

wherein the rotary union is a rotating structure that allow the lotion to flow from the pump into the brush manifold as the brush head is rotating relative to the base pan;

wherein the brush manifold is a manifold;

wherein the brush manifold forms a fluidic connection between the rotary union and the bristle structure of the brush head such that the lotion flows through the bristle structure onto the patient.

* * * * *